US010389070B2

(12) United States Patent
Takahashi

(10) Patent No.: US 10,389,070 B2
(45) Date of Patent: Aug. 20, 2019

(54) COAXIAL CONNECTOR AND COAXIAL CONNECTOR DEVICE

(71) Applicant: HIROSE ELECTRIC CO., LTD., Tokyo (JP)

(72) Inventor: Keisuke Takahashi, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/057,283

(22) Filed: Aug. 7, 2018

(65) Prior Publication Data

US 2019/0052030 A1 Feb. 14, 2019

(30) Foreign Application Priority Data

Aug. 10, 2017 (JP) ..... 2017-155753

(51) Int. Cl.

| | |
|---|---|
| ***H01R 24/56*** | (2011.01) |
| ***H01R 24/50*** | (2011.01) |
| *H01R 13/20* | (2006.01) |
| *H01R 13/50* | (2006.01) |

(52) U.S. Cl.

CPC ..... *H01R 24/56* (2013.01); *H01R 24/50* (2013.01); *H01R 13/20* (2013.01); *H01R 13/50* (2013.01)

(58) Field of Classification Search

CPC ..... H01R 24/50; H01R 24/56; H01R 13/052

USPC ..... 439/63, 581

See application file for complete search history.

(56) References Cited

U.S. PATENT DOCUMENTS

| | | | | |
|---|---|---|---|---|
| 5,123,864 | A | 6/1992 | Karlovich | |
| 6,074,217 | A * | 6/2000 | Maruyama | H01R 13/20 439/581 |
| 6,503,100 | B2 * | 1/2003 | Yamane | H01R 4/023 439/582 |
| 6,761,571 | B2 * | 7/2004 | Hida | H01R 24/46 439/188 |
| 7,896,666 | B2 * | 3/2011 | Tung | H01R 13/4538 439/141 |

(Continued)

FOREIGN PATENT DOCUMENTS

| | | |
|---|---|---|
| JP | 6068938 | 3/1994 |
| JP | 3356301 | 12/2002 |
| JP | 5757153 | 7/2015 |

*Primary Examiner* — Tulsidas C Patel
*Assistant Examiner* — Marcus E Harcum
(74) *Attorney, Agent, or Firm* — Rankin, Hill & Clark LLP

(57) ABSTRACT

A coaxial connector is provided which has a shell having a mating portion for mating with a counterpart connector, a signal terminal having a contact portion for contacting a counterpart signal terminal of the counterpart connector, and a housing having a cylindrical portion supporting the signal terminal, wherein the cylindrical portion is internally mounted to the mating portion with a part of an outer peripheral surface of the cylindrical portion attached to an inner peripheral surface of the mating portion, the contact portion of the signal terminal is on a center of the mating portion extending toward a mating with the counterpart connector, and the inner peripheral surface of the mating portion includes an annular no-attachment area in which the outer peripheral surface of the cylindrical portion is not attached, the no-attachment area being disposed between a farthest-end surface of the mating portion and a position spaced apart from the farthest-end surface of the mating portion in a mating direction.

10 Claims, 2 Drawing Sheets

(56) References Cited

U.S. PATENT DOCUMENTS

| | | | | |
|---|---|---|---|---|
| 7,993,144 | B2 * | 8/2011 | Hu | H01R 13/405 439/63 |
| 8,251,762 | B2 * | 8/2012 | Maier | H01R 13/64 439/521 |
| 8,636,542 | B2 | 1/2014 | Funahashi | |
| 2006/0046547 | A1 * | 3/2006 | Matsuo | H01R 13/7031 439/188 |
| 2008/0139057 | A1 * | 6/2008 | Fukuchi | H01R 13/658 439/884 |
| 2009/0042427 | A1 * | 2/2009 | Nakagawa | H01R 24/46 439/188 |
| 2011/0275243 | A1 * | 11/2011 | Taguchi | H01R 13/6473 439/578 |
| 2012/0295477 | A1 | 11/2012 | Funahashi | |
| 2015/0104974 | A1 * | 4/2015 | Hirakawa | H01R 24/50 439/578 |

* cited by examiner

COAXIAL CONNECTOR AND COAXIAL CONNECTOR DEVICE

CROSS-REFERENCE TO RELATED APPLICATION

This application claims priority from Japanese Patent Application No. 2017-155753 filed with the Japan Patent Office on Aug. 10, 2017, the entire content of which is hereby incorporated by reference.

BACKGROUND

1. Technical Field

The present disclosure relates to a coaxial connector and a coaxial connector device.

2. Related Art

JP-B2-5757153 discloses a coaxial connector.

The shell of a coaxial connector, particularly the shell having an annular mating portion, is generally formed by bending a punched-out metal plate. According to the typical manufacturing method, a joint gap is inevitably formed in a part of the shell, or more specifically in an annular mating portion to be mated with the shell of a counterpart connector. In the case where housing resin may enter the joint gap of the shell when a housing is integrally molded with the shell, and the housing resin may adversely affect the signal characteristics of the coaxial connector.

It is well known that the signal characteristics of a coaxial connector is greatly influenced by the state between an inner peripheral surface of the mating portion of the shell and a contact portion of the signal terminal. The state herein may include the distance between the inner peripheral surface of the mating portion of the shell and the contact portion of the signal terminal, and the permittivity of the material (such as the housing resin or air) interposed therebetween. With the demand for improvements in high frequency characteristics growing, the influence of the housing resin that has entered the joint gap cannot be disregarded.

In recent years, it has become possible, due to technical advancements, to form the shell of a coaxial connector by pressing, such as drawing as described in JP-A-6-68938, for example. Pressing reduces the formation of the joint gap in the mating portion of the shell. Accordingly, when the housing is integrally molded, the likelihood of the entry of resin into the joint gap is reduced. However, in this case, for processing reasons, deformation or wrinkles develops in the inner peripheral surface of the mating portion of the shell, or more specifically, in an inner peripheral surface of an annular edge of the inner peripheral surface in the vicinity of a farthest-end surface on the side for mating with the counterpart connector. As a result, when the housing is integrally molded with the metal shell, and particularly when a cylindrical portion of the housing is internally mounted to the mating portion of the shell, the housing resin may rise via the deformation or wrinkles along the inner peripheral surface toward the side for mating with the counterpart connector. Consequently, the state between the inner peripheral surface of the mating portion of the shell and the contact portion of the signal terminal may be affected.

SUMMARY

A coaxial connector according to the present disclosure includes a shell having an annular mating portion for externally mating with a counterpart shell of a counterpart connector, a signal terminal having a contact portion for contacting a counterpart signal terminal of the counterpart connector, and a housing having a cylindrical portion with a bottom and supporting the signal terminal, wherein the cylindrical portion is integrally internally mounted to the mating portion with at least a part of an outer peripheral surface of the cylindrical portion attached to an inner peripheral surface of the mating portion, the cylindrical portion includes a recess for internally mating with a part of a counterpart housing of the counterpart connector, the contact portion of the signal terminal is disposed at a center position in a radial direction of the mating portion and extends toward a side for mating with the counterpart connector, and the inner peripheral surface of the mating portion includes an annular no-attachment area in which the outer peripheral surface of the cylindrical portion is not attached, the no-attachment area being disposed between a farthest-end surface of the mating portion and a position spaced apart from the farthest-end surface of the mating portion in a mating direction.

DETAILED DESCRIPTION

Figure 1:
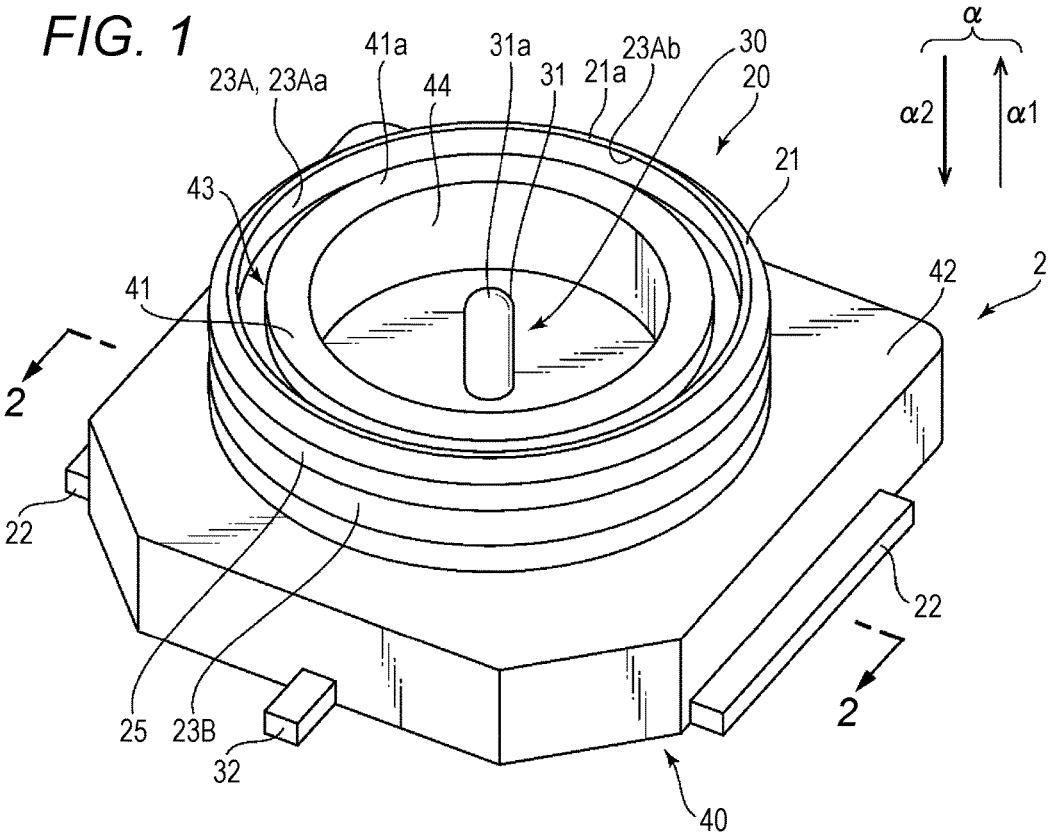
FIG. 1 is a perspective view of a coaxial connector according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

An object of the present disclosure is to solve the problems of the typical techniques. Specifically, an object is to restrain, when the cylindrical portion of the housing (hereinafter simply referred to as "cylindrical portion") is internally mounted to the mating portion of the shell (hereinafter simply referred to as "mating portion"), a rise of the housing resin along the inner peripheral surface of the mating portion toward the side for mating with the counterpart connector, via a deformation or wrinkles caused by pressing and the like. Accordingly, there is provided a coaxial connector, in which an inner peripheral surface of a mating portion includes a no-attachment area in which an outer peripheral surface of a cylindrical portion is not mounted, between a farthest-end surface of the mating portion and a position which is spaced apart from the farthest-end surface of the mating portion in a mating direction beyond a distal end of a contact portion of a signal terminal. There is also provided a coaxial connector device in which the coaxial connector is utilized.

In order to solve the above problem, one aspect of the present disclosure provides a coaxial connector including a shell having an annular mating portion for externally mating with a counterpart shell of a counterpart connector, a signal terminal having a contact portion for contacting a counterpart signal terminal of the counterpart connector, and a housing having a cylindrical portion with a bottom and supporting the signal terminal, wherein the cylindrical portion is integrally internally mounted to the mating portion with at least a part of an outer peripheral surface of the cylindrical portion attached to an inner peripheral surface of the mating portion, the cylindrical portion includes a recess for internally mating with a part of a counterpart housing of the counterpart connector, the contact portion of the signal terminal is disposed at a center position in a radial direction of the mating portion and extends toward a side for mating with the counterpart connector, and the inner peripheral surface of the mating portion includes an annular no-attachment area in which the outer peripheral surface of the cylindrical portion is not attached, the no-attachment area being disposed between a farthest-end surface of the mating portion and a position spaced apart from the farthest-end surface of the mating portion in a mating direction.

In the coaxial connector according to the above embodiment, the inner peripheral surface of the mating portion includes the no-attachment area in which the outer peripheral surface of the cylindrical portion is not attached, the no-attachment area being disposed between the farthest-end surface of the mating portion and the position spaced apart from the farthest-end surface of the mating portion in the mating direction. Accordingly, even when the cylindrical portion of the housing is internally mounted to the mating portion of the shell by integral molding, the resin for forming the cylindrical portion is restrained from rising along the inner peripheral surface of the mating portion toward the side for mating with the counterpart connector. In addition, by providing the recess, it becomes possible to use the cylindrical portion internally mounted to the mating portion for mating with the housing of the counterpart connector.

In the coaxial connector according to the above embodiment, the no-attachment area may be disposed between the farthest-end surface of the mating portion and a position spaced apart from the farthest-end surface of the mating portion in the mating direction at least beyond the distal end of the contact portion of the signal terminal. In this way, it becomes further possible to effectively restrain the rise of resin toward the side for mating with the counterpart connector.

In the coaxial connector according to the above embodiment, preferably, the farthest-end surface of the cylindrical portion on the side for mating with the counterpart connector reaches at least the distal end of contact portion of the signal terminal in the mating direction.

In the coaxial connector according to the above embodiment, the no-attachment area may be formed of a step portion which is recessed from an annular farthest-end surface of the cylindrical portion on the side for mating with the counterpart connector and away from the farthest-end surface in the mating direction.

When the step portion is used as the no-attachment area, the height of the farthest-end surface of the mating portion is not decreased. Accordingly, it becomes possible to restrain the rise of resin while the mating accuracy with the counterpart connector is maintained.

In the coaxial connector according to the above embodiment, when the mating portion is provided with the locking portion for locking the counterpart shell on the mating portion in such a way that the distance between the outer peripheral surface of the mating portion and the contact portion of the signal terminal is changed in the radial direction of the mating portion, the no-attachment area is preferably disposed between the farthest-end surface of the mating portion and a position which is closer to the counterpart connector than to the locking portion in the mating direction.

When the locking portion is provided in such a way that the distance between the outer peripheral surface of the mating portion and the contact portion of the signal terminal is changed, the permittivity between the mating portion and the contact portion may be changed. Thus, the no-attachment area is intentionally not provided in the area where the permittivity may be changed.

In the coaxial connector according to the above embodiment, the locking portion may be an annular depression in the outer peripheral surface of the mating portion which is recessed from the outer peripheral surface of the mating portion toward the inner peripheral surface thereof.

In the coaxial connector according to the above embodiment, preferably, the mating portion may be formed by drawing.

The mating portion may be formed by pressing, such as drawing.

In the coaxial connector according to the above embodiment, the coaxial connector may be of substrate mount type.

According to the present disclosure, it becomes possible, when the cylindrical portion of the housing is internally mounted to the mating portion of the shell, to restrain the rise of housing resin, via deformation or wrinkles caused by pressing and the like, along the inner peripheral surface of the mating portion toward the side for mating with the counterpart connector. That is, according to the present disclosure, there is provided a coaxial connector wherein the inner peripheral surface of the mating portion includes the no-attachment area in which the outer peripheral surface of the cylindrical portion is not attached, the no-attachment area being disposed between the farthest-end surface of the mating portion and a position spaced apart from the farthest-end surface of the mating portion beyond the distal end of the signal terminal in the mating direction. There is also provided a coaxial connector device in which the coaxial connector is utilized.

In the following, a preferred embodiment of the present disclosure will be described with reference to the attached drawings. While only the preferred embodiment will be described, it should be understood that this is for convenience of description and is not intended to be limiting the embodiments of the present disclosure.

Figure 2:
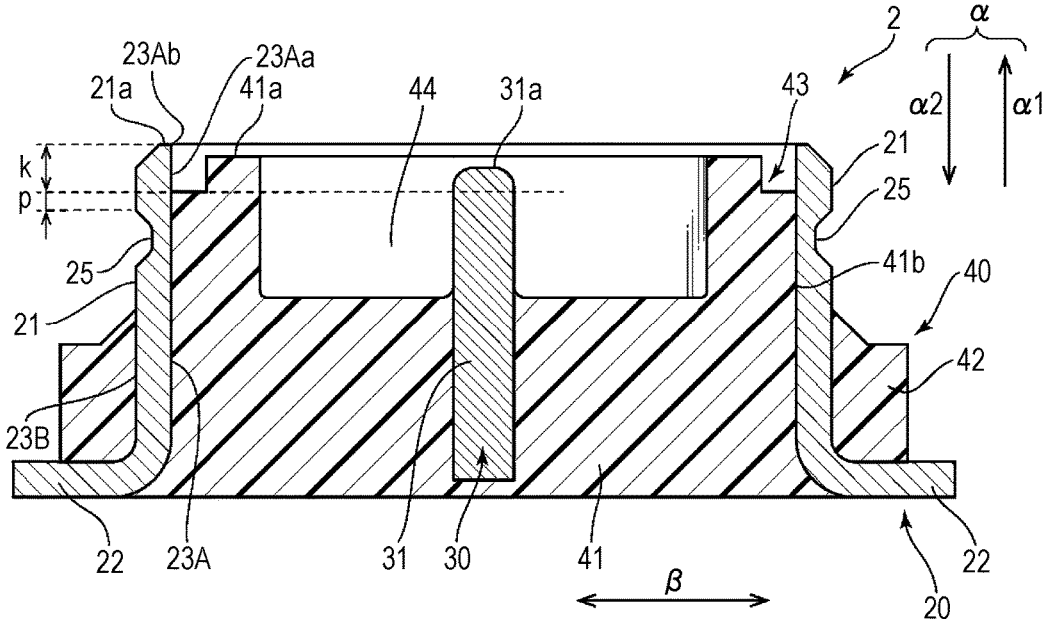
FIG. 2 is a cross sectional view taken along line 2-2 of FIG. 1.

FIG. 1 is a perspective view of a coaxial connector 2 according to an embodiment of the present disclosure. FIG. 2 is a cross sectional view taken along line 2-2 of FIG. 1. While not illustrated in the drawings, the coaxial connector 2 may be combined with a counterpart connector to constitute a coaxial connector device.

Figure 3:
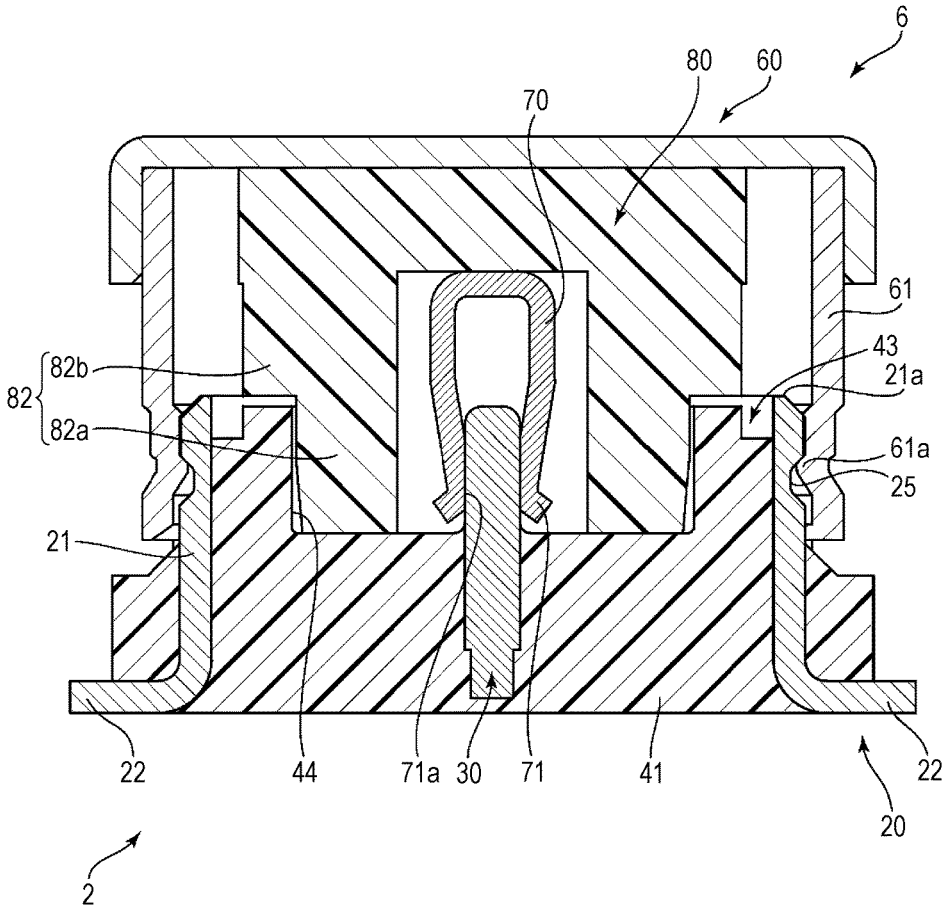
FIG. 3 is a diagram illustrating the coaxial connector mated with an example of a counterpart connector.

FIG. 3 illustrates an example of a counterpart connector in a state of having been mated with the coaxial connector 2. The example of the counterpart connector herein is a coaxial cable connector 6 to which a coaxial cable (not illustrated) can be connected. In FIG. 3, particularly, the vicinity of a portion of the coaxial cable connector 6 that is mated with the coaxial connector 2 is illustrated, together with the coaxial connector 2, in a cross sectional view taken along a center line. The coaxial cable connector 6 is mainly provided with a signal terminal 70, a housing 80 integrally molded with the signal terminal 70, and a metal shell 60 which covers the exterior of the housing 80, and which is fixed to the coaxial cable by swaging (not illustrated), for example. The counterpart connector is only required to be capable of being connected with the coaxial connector 2.

Thus, the counterpart connector is not limited to the coaxial cable connector 6 as illustrated in FIG. 3, and may be other typical connectors.

The coaxial connector 2 mainly includes a signal terminal 30 that contacts the counterpart signal terminal 70 of the counterpart connector 6, a metal shell 20 with which the counterpart shell 60 of the counterpart connector 6 is mated, and a resin housing 40 integrally molded with respect to the signal terminal 30 and the shell 20.

The shell 20 includes an annular mating portion 21 extending in a mating direction ("α" direction indicated by arrows) of the counterpart connector 6 and vertically with respect to a substrate, and leg portions 22 extending horizontally along the substrate on the bottom side of the mating portion 21. The leg portions 22 may extend in two opposing directions, for example. The counterpart shell 60 of the counterpart connector 6, when externally mated with the mating portion 21 at a substantially tubular portion 61 of the counterpart shell 60, may be physically and electrically connected with the shell 20. In actual use, the leg portions 22 may be fixed to the substrate (not illustrated) by soldering, for example. Accordingly, the coaxial connector 2 can be used as a surface mount-type connector.

The shell 20 is formed by pressing such as drawing a single sheet of metal plate that has been punched out in a predetermined shape. Due to the use of pressing, no joint gap exists in the mating portion 21.

The signal terminal 30 includes a contact portion 31 extending in the direction "α" for mating with the counterpart connector 6 and disposed vertically with respect to the substrate, and a leg portion 32 extending horizontally along the substrate at the bottom side of the contact portion 31. Thus, the signal terminal 30 has an L-shape in a side view. In practice, the signal terminal 30 is used in a state in which the leg portion 32 is fixed to the substrate by soldering, for example. The counterpart signal terminal 70 of the counterpart connector 6 includes a contact portion 71 with a contact 71*a* configured to contact the contact portion 31 of the signal terminal 30. The contact portion 31 is disposed at the center position in the radial direction (direction "ß" indicated by arrows) of the mating portion 21, and extends in the direction "α" for mating with the counterpart connector 6 toward the side for mating with the counterpart connector 6.

The housing 40 is attached to the shell 20 by integral molding. The housing 40 includes a cylindrical portion 41 having a bottom and internally mounted to the mating portion 21 of the shell 20, and a mount portion 42 having a rectangular shape in plane view and externally mounted to the mating portion 21 of the shell 20. The signal terminal 30 is supported by the housing 40, with the contact portion 31 exposed to the outside via the cylindrical portion 41 and with the leg portion 32 exposed to the outside via the mount portion 42.

The cylindrical portion 41 has a recess 44 on the side for mating with the counterpart connector 6. The recess 44 is configured to be internally mated with a small diameter portion 82*a* of a substantially cylindrical portion 82 of the counterpart housing 80 of the counterpart connector 6. The substantially cylindrical portion 82 includes a large diameter portion 82*b* as well as the small diameter portion 82*a*, which is internally mated in the recess 44. The recess 44 allows the cylindrical portion 41 internally mounted to the mating portion 21 to be used as a reference for the mating with the housing of the counterpart connector 6. Thus, it is possible to connect the connectors more reliably than when the connectors are mated using the shells as a reference.

The signal characteristics of the coaxial connector 2 is greatly influenced by the state between the inner peripheral surface 23A of the mating portion 21 and the contact portion 31 of the signal terminal 30. The state may include the distance between the inner peripheral surface 23A and the contact portion 31, and the permittivity of the material interposed therebetween, such as the cylindrical portion 41 of the housing 40 and air. Accordingly, it is preferable to make the state as uniform as possible along the entire length in the mating direction "α".

In order to obtain a uniform state, in the direction for mating with the counterpart connector 6 (direction "α1" indicated by arrow), a farthest-end surface 21*a* of the mating portion 21 on the side for mating with the counterpart connector 6 reaches at least a farthest-end surface 41*a* of the cylindrical portion 41 on the side for mating with the counterpart connector 6. The farthest-end surface 41*a* reaches at least a distal end 31*a* of the contact portion 31.

Obviously, if this configuration is employed, the contact portion 31 is the lowest in the direction for mating with the counterpart connector 6 (direction "α1" indicated by arrow). More specifically, the height may decrease in the order of the farthest-end surface 21*a* of the mating portion 21, the farthest-end surface 41*a* of the cylindrical portion 41, and the distal end 31*a* of the contact portion 31. Alternatively, the farthest-end surface 21*a* of the mating portion 21, the farthest-end surface 41*a* of the cylindrical portion 41, and the distal end 31*a* of the contact portion 31 may have the same height. Alternatively, the farthest-end surface 21*a* of the mating portion 21 and the farthest-end surface 41*a* of the cylindrical portion 41 may have the same height, while the distal end 31*a* of the contact portion 31 may be lower than the two. Alternatively, the farthest-end surface 41*a* of the cylindrical portion 41 and the distal end 31*a* of the contact portion 31 may have the same height, while the farthest-end surface 21*a* of the mating portion 21 may be higher than two.

When the height of the contact portion 31 is set to be the lowest, or when the respective heights are at least set to be the same, the contact portion 31 is covered by both the mating portion 21 and the cylindrical portion 41 in the radial direction "ß", along the entire length in the mating direction "α". Accordingly, at least the state between the inner peripheral surface 23A of the mating portion 21 and the contact portion 31 of the signal terminal 30 can be uniformly maintained.

Such height relationships are also effective in restraining a rise of resin. As described above, the shell 20 is formed by pressing. With this configuration, the mating portion 21 does not have a joint gap formed therein, and therefore there is no fear of entry of housing resin into the joint gap. However, deformation or wrinkles (not illustrated) may be caused in the inner peripheral surface 23A of the mating portion 21, particularly the annular inner peripheral surface (23Aa) in the vicinity of the farthest-end surface 21*a* on the side for mating with the counterpart connector 6, and especially in the vicinity of an end portion 23Ab on the side for mating with the counterpart connector 6 which is formed as a die is removed from the inner peripheral surface 23A. As is well known, when the housing 40 is integrally molded with respect to the shell 20 or the signal terminal 30, resin is injected in the die (not illustrated) having a shape complementary to the housing shape having been inserted into the mating portion of the shell 21 from the side for mating with the counterpart connector 6. Through the injection operation, the housing 40 is mounted to the mating portion 21 with at least a part of the outer peripheral surface 41*b* of the cylindrical portion 41 being closely attached to the inner peripheral surface 23A of the mating portion 21. In this case, if the inner peripheral surface 234 has deformation or wrinkles, gaps may be caused between the die and the inner peripheral surface 23A. Through the gaps, the resin may rise toward the side for mating with the counterpart connector 6 and reach the portion (23Aa) to which the outer peripheral surface of the cylindrical portion 41 is not originally supposed to attach.

In the present configuration, the farthest-end surface 21*a* of the mating portion 21 is set to be higher than, or at least as high as, the farthest-end surface 41*a* of the cylindrical portion 41. Accordingly, the problem of the rise of resin can be effectively restrained.

In addition, in the present embodiment, the inner peripheral surface 23A of the mating portion 21 includes an annular no-attachment area 23Aa in which the substantially cylindrical portion 41 is not attached, between the farthest-end surface 21*a* of the mating portion 21 and a position spaced apart from the farthest-end surface 21*a* beyond the distal end 31*a* of the signal terminal 30 in the mating direction "α", i.e., annular portion shown as "k". Accordingly, the rise of resin can be effectively restrained. In this case, the no-attachment area 23Aa extends to a position deeper than the distal end 31*a* of the contact portion 31 which is positioned to be the lowest in the mating direction "α". This means that the integral molding is performed with the die deeply inserted to the position of the inner peripheral surface 23A where there is no deformation or wrinkles and where a true circular shape is ensured. As a result, it becomes possible to keep the resin away, during integral molding, from the vicinity of the annular inner peripheral surface (23Aa) in the vicinity of the farthest-end surface 21*a* on the side for mating with the counterpart connector 6, especially from the vicinity of the end portion 23Ab on the side for mating with the counterpart connector 6 which is formed as the die is removed from the inner peripheral surface 23A. Thus, the problem of the rise of resin can be effectively restrained.

The no-attachment area 23Aa may be formed by providing a step portion 43. The step portion 43 is formed as a groove-shaped step portion along the inner peripheral surface 23A. The groove-shaped step portion is recessed from the annular farthest-end surface 41*a* of the cylindrical portion 41 on the side for mating with the counterpart connector 6, in the mating direction "α" away from the farthest-end surface 41*a* (direction "α2" indicated by arrow). When the no-attachment area 23Aa employs the step portion 43, it is not necessary to reduce the height of the farthest-end surface 41*a* of the mating portion 21. Accordingly, the rise of resin can be restrained while the accuracy of mating with the counterpart connector 6 is maintained.

The mating portion 21 may include a locking portion 25 for locking with the counterpart shell 60. The locking portion 25 is configured to be locked with a part of the counterpart shell 60, particularly an annular contact portion 61*a* (see FIG. 3) formed on the substantially tubular portion 61 and protruding inward. The locking portion 25 may be formed as an annular depression in the mating portion 21 which is recessed from an outer peripheral surface 23B of the mating portion 21 toward the inner peripheral surface 23A. The annular depression 25 may be formed by narrowing the outer peripheral surface 23B of the mating portion 21 toward the side of the inner peripheral surface 23A. In this case, however, the distance between the inner peripheral surface 23A of the mating portion 21 and the contact portion 31 in the mating portion 21 may be changed in the radial direction "ß", which may not be visually detectable. In other words, the distance between the inner peripheral surface 23A of the mating portion 21 and the contact portion 31 of the signal terminal 30 may be changed. As a result, the signal characteristics of the coaxial connector 2 may be adversely affected. Accordingly, when the locking portion 25 is provided in such a way that the distance between the inner peripheral surface 23A of the mating portion 21 and the contact portion 31 of the signal terminal 3C) is changed in the radial direction "ß" of the mating portion 21, the no-attachment area 23Aa is preferably provided between the farthest-end surface 21*a* of the mating portion 21 and a position which is closer to the farthest-end surface 21*a* than to the locking portion 25 in the mating direction "α", as indicated by an annular area "k". In other words, it is preferable that the depth to which the die is placed is positioned closer to the counterpart connector 6 than to the locking portion 25. In this way, it becomes possible to provide a predetermined distance "p" between the locking portion 25 and the step portion 43, for example, in the mating direction "α". This makes it possible to avoid providing the no-attachment area 23Aa in an area where the permittivity may be changed. As a result, degradation of signal characteristics can be restrained.

While a preferable embodiment has been described, it should be understood that the coaxial connector and the coaxial connector device that have been described are merely representative of the coaxial connector and the coaxial connector device according to the present embodiment. It will be readily apparent to a person skilled in the art that the embodiment that has been described may be modified or changed into a different embodiment in light of the teachings above. Accordingly, illustrative or alternative embodiments may be implemented without departing from the scope and spirit of the invention set forth in the appended claims.

The coaxial connector of the present disclosure may include the following first to eighth coaxial connectors.

The first coaxial connector includes a shell having an annular mating portion with which a counterpart shell of a counterpart connector is externally mated, a signal terminal having a contact portion which contacts a counterpart signal terminal of the counterpart connector, and a housing having a cylindrical portion with a bottom and supporting the signal terminal, wherein the cylindrical portion is internally mounted to the mating portion by integral molding in such a way that at least a part of an outer peripheral surface of the cylindrical portion is mounted to an inner peripheral surface of the mating portion, the cylindrical portion includes a recess in which a part of a counterpart housing of the counterpart connector is internally mated, the contact portion of the signal terminal is disposed at a center position in a radial direction of the mating portion and extends toward the side for mating with the counterpart connector in a direction for mating with the counterpart connector, and an annular no-attachment area in which the outer peripheral surface of the cylindrical portion is not attached to the inner peripheral surface of the mating portion is disposed on an opposite side, in the mating direction, from the side for mating with the counterpart connector, beyond a farthest-end surface of the mating portion.

The second coaxial connector is the first coaxial connector wherein the no-attachment area is disposed on the opposite side in the mating direction from the side for mating with the counterpart connector, beyond at least a distal end of the contact portion of the signal terminal.

The third coaxial connector is the first or the second coaxial connector wherein the farthest-end surface of the cylindrical portion on the side for mating with the counterpart connector reaches, in the direction extending toward the side for mating with the counterpart connector, at least a distal end of the contact portion of the signal terminal, and the farthest-end surface of the mating portion on the side for mating with the counterpart connector reaches, in the direction extending toward the side for mating with the counterpart connector, at least the farthest-end surface of the cylindrical portion on the side for mating with the counterpart connector.

The fourth coaxial connector is the third coaxial connector wherein the no-attachment area is formed of a step portion including a recess in the farthest-end surface of the cylindrical portion which is recessed toward the opposite side from the side for mating with the counterpart connector in the mating direction, in an annular outer edge of the cylindrical portion on the side for mating with the counterpart connector.

The fifth coaxial connector is any one of the first to fourth coaxial connector, including a locking portion for locking the counterpart shell on the mating portion in such a way that a distance between the inner peripheral surface of the mating portion and the contact portion of the signal terminal in the radial direction of the mating portion is changed, wherein the no-attachment area is disposed between, in the mating direction, the farthest-end surface of the mating portion and a part thereof on the side for mating with the counterpart connector with respect to the locking portion.

The sixth coaxial connector is the fifth coaxial connector wherein the locking portion is an annular depression in the outer peripheral surface of the mating portion which is recessed from the outer peripheral surface of the mating portion toward the inner peripheral surface.

The seventh coaxial connector is any one of the first to sixth coaxial connector wherein the mating portion is formed by drawing.

The eighth coaxial connector is any one of the first to seventh coaxial connector wherein the coaxial connector is of substrate mount type.

A coaxial connector device of the present disclosure may be configured from any one of the first to eighth coaxial connector and the counterpart connector.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A coaxial connector comprising:

a shell having an annular mating portion for externally mating with a counterpart shell of a counterpart connector;

a signal terminal having a contact portion for contacting a counterpart signal terminal of the counterpart connector; and a housing having a cylindrical portion with a bottom and supporting the signal terminal, wherein the cylindrical portion is integrally internally mounted to the mating portion with at least a part of an outer peripheral surface of the cylindrical portion attached to an inner peripheral surface of the mating portion;

the cylindrical portion includes a recess for internally mating with a part of a counterpart housing of the counterpart connector;

the contact portion of the signal terminal is disposed at a center position in a radial direction of the mating portion and extends toward a side for mating with the counterpart connector;

the inner peripheral surface of the mating portion includes an annular no-attachment area in which the outer peripheral surface of the cylindrical portion is not attached, the no-attachment area being disposed between a farthest-end surface of the mating portion and a position spaced apart from the farthest-end surface of the mating portion in a mating direction;

the mating portion comprises a locking portion for locking the counterpart shell on the mating portion; and the outer peripheral surface of the cylindrical portion is in direct contact with the inner peripheral surface of the mating portion at least at a position closer to the farthest-end surface of the mating portion than the locking portion is in the mating direction.

2. The coaxial connector according to claim 1, wherein the no-attachment area is disposed between the farthest-end surface of the mating portion and a position spaced apart from the farthest-end surface of the mating portion at least beyond a distal end of the contact portion of the signal terminal in the mating direction.

3. The coaxial connector according to claim 1, wherein an annular farthest-end surface of the cylindrical portion on the side for mating with the counterpart connector reaches at least a distal end of the contact portion of the signal terminal on the side for mating with the counterpart connector.

4. The coaxial connector according to claim 3, wherein the no-attachment area is formed of a step portion which is recessed from the annular farthest-end surface of the cylindrical portion on the side for mating with the counterpart connector and away from the farthest-end surface in the mating direction.

5. The coaxial connector according to claim 1, wherein the locking portion is configured to lock the counterpart shell on the mating portion in such a way that a distance between the inner peripheral surface of the mating portion and the contact portion of the signal terminal is changed in the radial direction of the mating portion, wherein the no-attachment area is disposed between the farthest-end surface of the mating portion and a position which is closer to the farthest-end surface of the mating portion than to the locking portion in the mating direction.

6. The coaxial connector according to claim 5, wherein the locking portion is an annular depression in the outer peripheral surface of the mating portion which is recessed from the outer peripheral surface of the mating portion toward the inner peripheral surface thereof.

7. The coaxial connector according to claim 1, wherein the mating portion is formed by drawing.

8. The coaxial connector according to claim 1, wherein the coaxial connector is of substrate mount type.

9. A coaxial connector device comprising:

the coaxial connector of claim 1; and the counterpart connector.

10. A coaxial connector comprising:

a shell having an annular mating portion for externally mating with a counterpart shell of a counterpart connector;

a signal terminal having a contact portion for contacting a counterpart signal terminal of the counterpart connector; and a housing having a cylindrical portion with a bottom and supporting the signal terminal, wherein the cylindrical portion is integrally internally mounted to the mating portion with at least a part of an outer peripheral surface of the cylindrical portion attached to an inner peripheral surface of the mating portion;

the cylindrical portion includes a recess for internally mating with a part of a counterpart housing of the counterpart connector;

the contact portion of the signal terminal is disposed at a center position in a radial direction of the mating portion and extends toward a side for mating with the counterpart connector;

the inner peripheral surface of the mating portion includes an annular no-attachment area in which the outer peripheral surface of the cylindrical portion is not attached, the no-attachment area being disposed between a farthest-end surface of the mating portion and a position spaced apart from the farthest-end surface of the mating portion in a mating direction;

the mating portion comprises a locking portion for locking the counterpart shell on the mating portion; and an annular farthest-end surface of the cylindrical portion is positioned closer to the farthest-end surface of the mating portion than the locking portion is in the mating direction.

* * * * *